United States Patent [19]

Spater

[11] 4,308,805

[45] Jan. 5, 1982

[54] HIGH TEMPERATURE DAMPER

[75] Inventor: Stuart S. Spater, Livingston, N.J.

[73] Assignee: Nichols Engineering & Research Corp., Belle Mead, N.J.

[21] Appl. No.: 57,699

[22] Filed: Jul. 16, 1979

[51] Int. Cl.[3] ..... F23L 1/00; F23L 13/00

[52] U.S. Cl. ..... 110/163; 137/375; 110/225; 126/285 R

[58] Field of Search ..... 110/163, 225; 126/285 R; 137/338, 340, 375

[56] References Cited

U.S. PATENT DOCUMENTS

| | | | |
|---|---|---|---|
| 1,542,989 | 6/1925 | Connery | 126/285 R |
| 2,252,326 | 8/1941 | Lewers | 110/225 |
| 2,811,981 | 11/1957 | Harris | 137/340 |
| 3,084,715 | 4/1963 | Scharres | 126/285 R |
| 3,143,132 | 8/1964 | Pangburn | 137/375 |
| 3,598,067 | 8/1971 | Jones | 110/163 |
| 3,837,620 | 9/1974 | Malloy et al. | 137/375 |
| 3,996,864 | 12/1976 | Jones | 110/163 |
| 4,027,654 | 6/1977 | Kannapell | 110/163 |
| 4,148,458 | 4/1979 | Holtgraver | 137/375 |

*Primary Examiner*—Henry C. Yuen

*Attorney, Agent, or Firm*—Fitzpatrick, Cella, Harper & Scinto

[57] ABSTRACT

There is disclosed a damper for controlling the flow of high temperature gases to respective hearth chambers of a multiple hearth furnace, for example, the damper being formed of temperature resistant ceramic plate having an air cooled shaft extending diametrically therethrough and insulated from the plate by a heat resistant ceramic fiber material.

5 Claims, 3 Drawing Figures

HIGH TEMPERATURE DAMPER

BACKGROUND OF THE INVENTION

1. Field of the Invention

This invention relates to plate type dampers, and more particularly, to such dampers for controlling the flow of hot gases in conduits such as breeching ports of various types of furnaces, for example.

2. Description of the Prior Art

In certain high temperature furnaces, such as multiple hearth furnaces of the Herreshoff type, a plurality of hearths, or hearth chambers, are vertically aligned and an elongated shaft extends up through the center of the furnace, passing through the floor of each hearth. Rabble arms are secured to the shaft and extend radially outwardly therefrom over each hearth floor. These arms are provided with rabble teeth which extend down into material being processed on the hearths. As the center shaft rotates, the rabble arms move over the material on the hearth floor causing the teeth to plow through it. Depending on the inclination of the teeth, the material will be moved radially inwardly toward the center shaft or outwardly therefrom. Drop holes are provided in each hearth floor either in toward the center shaft or out toward the furnace wall so that, as the material completes its movement over a hearth floor, it will drop down into the next lower hearth and move across that hearth in the direction opposite to that in the next adjacent upper hearth. Thus, the material is caused to move slowly in serpentine fashion through the furnace.

Because these furnaces permit close control of individual hearth atmospheres and temperatures, it is possible to perform very delicate operations such as the regeneration of spent bone char from the refining of cane and beet sugar, for example, while numerous other thermal treatment processes can also be performed. Thus, U.S. Pat. No. 3,153,633 to Von Dreusche discloses the use of a multiple hearth furnace for the regeneration of certain granular activated carbon absorbing agents.

In most furnaces of the aforementioned type, many of the hearths are directly fired and the heat requirement of each fired hearth is adjusted by varying the flow of air and fuel and the air-to-fuel ratio to each fired hearth. However, in some cases, it is necessary to fire the hearth chambers indirectly by supplying hot gases from an external combustion chamber and the flow of these gases to respective hearth chambers is controlled by dampers.

Butterfly dampers associated with various furnace hearth chambers have been designed for service at temperatures well below 2000° F. and such dampers have been constructed of high temperature nickel-chrome alloys and have been air cooled, water cooled or not cooled at all. However, operating and maintenance problems have been encountered with these butterfly type alloy dampers. Thus, on a recent commercially operated furnace of the type described, wherein it has been necessary to provide external combustion chambers indirectly to supply heat to each hearth to reduce cost and to obviate the possibility of flame impingement on the material being processed, two external combustion chambers were used with breechings to each of three hearth chambers. To control the flow of gases to these hearths, an extremely high temperature damper was required since the temperature attained at the damper positions was of the order of about 2300° F. to about 2800° F.

Water cooling of alloy dampers was considered, but this has the disadvantages of being extremely expensive, complicated and potentially dangerous in the event of water leakage. Refractory guillotine type dampers were also considered, but these are bulky, heavy, expensive, and difficult to maintain when airtightness is a requirement. Thus, these considerations were rejected.

SUMMARY OF THE INVENTION

In accordance with the present invention a damper is provided which overcomes the foregoing difficulties and disadvantages and to control the flow of high temperature gases in conduits such as breeching ports of furnaces.

Investigation of the problems resulting when various types of dampers are subjected to high temperatures has led to the present invention according to one aspect of which there is provided a blade of ceramic material capable of withstanding high temperatures and formed with a bore along an axis thereof, a shaft extending into said bore and keyed to the blade to impart rotary movement to the blade about the axis upon rotation of the shaft selectively to adjust the cross-sectional area of the conduit, and an insulating sleeve of ceramic fiber disposed between the shaft and the surface of the bore.

According to a further aspect of the invention, the shaft is hollow and means are provided for directing a flow of ambient air through the shaft.

The sleeve is fabricated of material having suitable thermal conductivity and linear shrinkage characteristics, specific details of which will later be described.

More specifically, the blade of ceramic material is capable of withstanding temperatures of the order of about 2800° F. and is formed with an enlarged section or hub along a major axis thereof and with a bore concentric with the hub. The shaft extends into the bore, and the insulating sleeve extends along between the shaft and the bore surface. Means are provided for mounting the blade within a conduit and for rotating the shaft to adjust the disposition of the blade relative to the conduit between positions wherein the conduit is substantially fully open and substantially fully closed.

There has thus been outlined rather broadly the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Specific embodiments of the invention have been chosen for purposes of illustration and description, and are shown in the accompanying drawings, forming a part of the specification wherein.

DESCRIPTION OF THE PREFERRED EMBODIMENT

Figure 1:
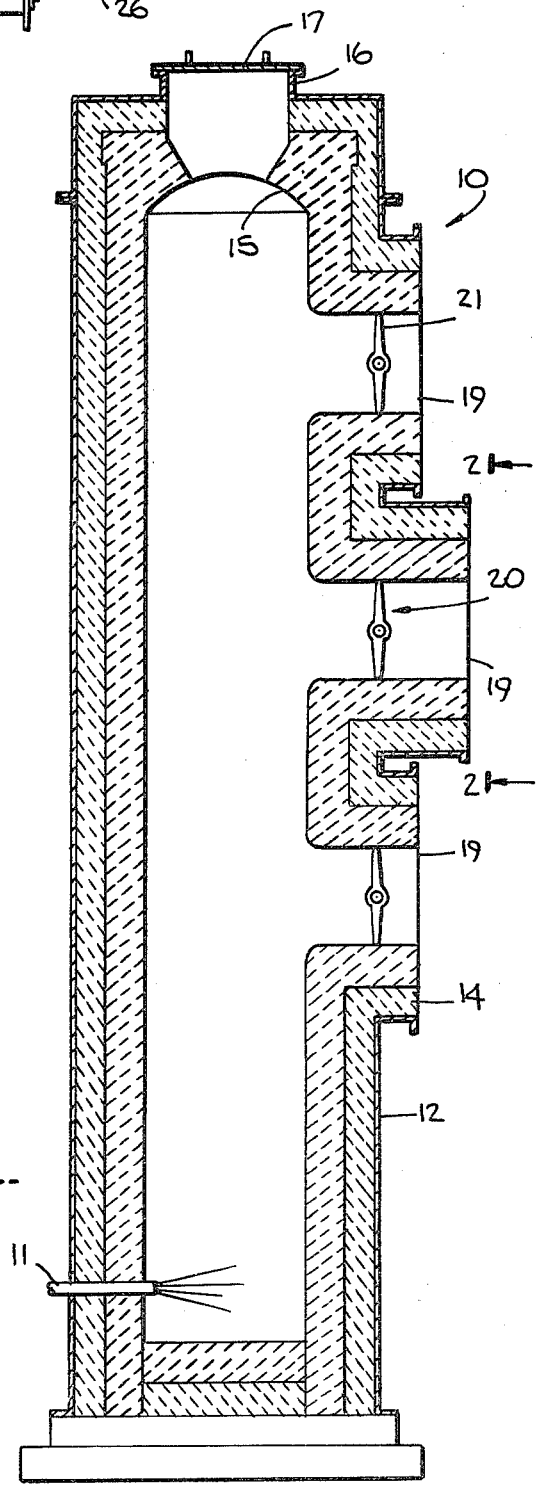
FIG. 1 is a schematic elevational view of a combustion chamber having three breeching ports each equipped with a damper according to the present invention.

Referring now to the drawing, and more particularly to FIG. 1 thereof, there is shown a combustion chamber 10 equipped with a fuel burner 11 near the bottom thereof, it being understood that while only a single burner is shown, any number may be employed. The chamber 10 may consist of a vertical, cylindrical shell 12 of sheet steel or the like lined with a refractory material 14 and having a domed top wall 15 communicating with an outlet or chimney 16, the flow through which may be controlled by a valve illustrated schematically at 17. The right side of the chamber 10, as viewed, is formed with three vertically aligned breeching ports 19, also lined with refractory material.

The high temperature gases generated in the chamber 10 flow out of the chamber via the breeching ports 19 and may be conveyed through suitable ducts joining the breeching port openings to respective hearth chambers of a multiple hearth furnace, for example. As described in the aforementioned U.S. Pat. No. 3,153,633, multiple hearth furnaces of the type contemplated may comprise a plurality of vertically aligned hearths defining hearth chambers therebetween, an elongated, rotatable shaft extending up through the center of the furnace and passing through the floor of each hearth, and means for moving material to be processed in the furnace downwardly to successively adjacent hearth chambers upon rotation of the shaft. Means defining breeching ports may be provided in selected hearth chambers.

Figure 2:
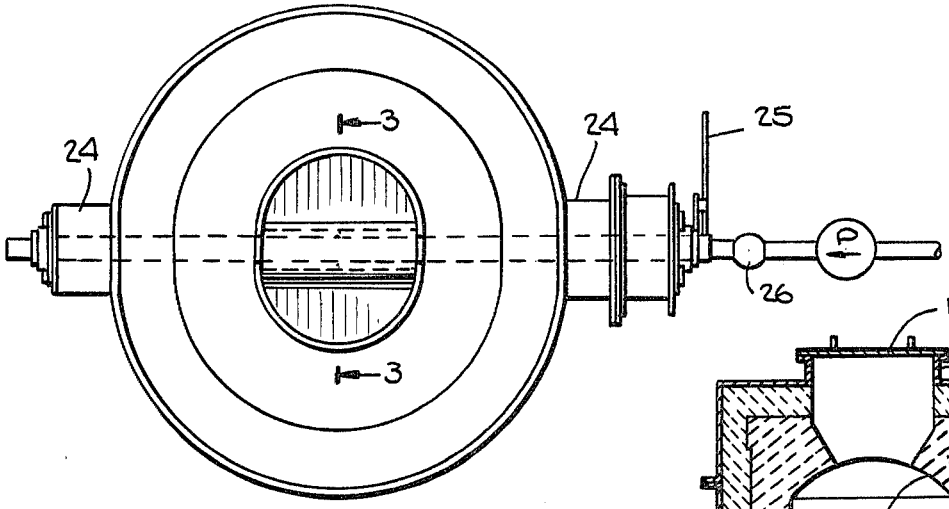
FIG. 2 is an elevational view of a breeching port viewed along the line 2—2 of FIG. 1 and illustrating a damper in fully closed position.

The flow of high temperature gases through each breeching port is controlled by a butterfly damper 20. As shown in FIG. 2, the damper 20 may take the form of a circular plate 21 through the horizontal axis of which passes a hollow shaft 22 to which the damper plate is keyed so that the plate 21, shown fully closing the breeching port 19, may be rotated to fully open position or any position between fully closed and fully opened, by rotation of the shaft up to a maximum of 90°. The shaft 22 is supported at each side of the breeching port by suitable closures 24 which do not constitute a part of the present invention but which may include suitable insulating packing and bearings. The position of the damper plate 21 in the port 19 is controlled, as stated, by controlling the annular position of the shaft 22 and this may be achieved by means of a manually or automatically operable control lever 25 fixed to the shaft outwardly of one of the closures 24 and shown extending radially of the shaft.

As has been mentioned, the shaft 22 is hollow to permit cooling, ambient air to pass through it and for this purpose, the outlet pipe of an air pump P is connected through a hollow ball and socket joint 26, or the like, to an end of the shaft, the opposite end of the shaft simply exhausting to atmosphere.

Figure 3:
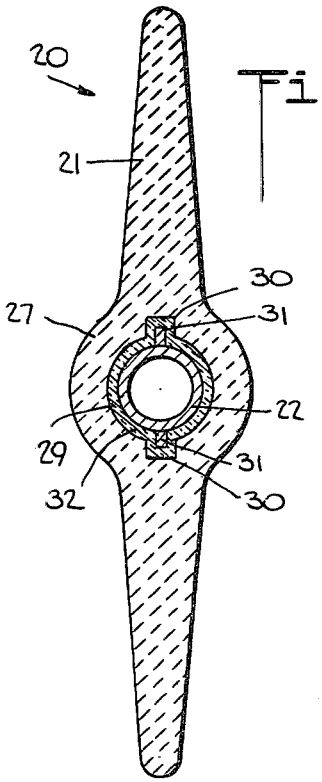
FIG. 3 is a cross-sectional view of a damper taken along the line 3—3 of FIG. 2.

Turning now to FIG. 3, the damper 20 is shown in section as an outwardly tapered plate 21 having an enlarged hub 27 disposed along the horizontal diameter of the plate. The hub 27 is through bored as at 29 and the bore is provided with a pair of diametrically opposed slots 30 which may extend the full length of the bore.

It is preferred to form the plate 21 of a high temperature resistant ceramic such as Korundal manufactured by Harbison-Walker Co. of Pittsburgh, Pennsylvania, the approximate composition of which is 91% $Al_2O_3$, 8% $SiO_2$ and less than 1% each of $Fe_2O_3$, CaO, MgO and alkalies, by weight. This material has a softening temperature of about 3500° F.

As has been mentioned, a hollow shaft passes through an axis of the plate 21 and is keyed to the plate. To this end, there is provided the shaft 22 having an outer diameter somewhat smaller than the diameter of the bore 29 so that it may extend freely through the length of the bore. A pair of keys 31 are formed integral with the shaft and are arranged to fit within respective slots 30 in the plate 21. A chrome-nickel steel alloy has been successfully employed as the material of which the shaft and keys are formed, the composition of which alloy is about 25% Cr, 15% Ni and 60% FE.

Those skilled in the art will appreciate that the shaft and keys would normally melt at operating or service temperatures of the order of 2300° F. to 2800° F. However, protection is afforded these elements by means of a ceramic fiber sleeve 32 extending along the full length of the shaft and disposed between the shaft and keys on the one hand and the surface defining the bore 29 on the other hand, and, as already stated, by passing a flow of ambient air through the shaft.

In a typical construction for service in the temperature range mentioned, the plate 21 may be of the order of 12 inches in diameter and of a thickness of 0.968 inches at the hub with a hub ID of 4.875 inches, the fiber sleeve 32 may then be of the order of 0.25 inch thick and the steel shaft 22 may have an ID of about 2.375 inches.

The ceramic fiber of which the sleeve 32 is fabricated has the following physical properties:

| | |
|---|---|
| Service Temperature | at least 2000° F. |
| Fire Resistance | incombustible |
| Thermal Conductivity (at 1600° F. mean temp.) | less than 2.5 BTU/in/Ft$^2$/Hr. |
| Linear Shrinkage (at service temp.) | no more than 5% |

A typical ceramic fiber material having the above characteristics is commercially available from Johns-Manville under the trademark J. M. Fiberchrome and has the following composition, by weight:

| | |
|---|---|
| $SiO_2$ | 54% |
| $Al_3O_3$ | 37.9% |
| $Cr_2O_3$ | 3.7% |
| $Fe_2O_3$ | 0.3% |
| CaO | 0.04% |
| MgO | 0.16% |
| $MnO_2$ | 0.01% |
| $K_2O$ | Trace |
| $Na_2O$ | 0.15% |

Also, other fiber materials, i.e. pure fibrous alumina and fibrous zirconia may be used to fabricate the sleeve 32.

It is believed that the construction and operation of the novel high temperature damper above described will now be understood and that the advantages thereof will be fully appreciated by those persons skilled in the art.

I claim:

1. A multiple hearth furnace including:

a plurality of vertically aligned hearths defining hearth chambers therebetween;

means defining breeching ports in selected hearth chambers;

an elongated, rotatable shaft extending up through the center of the furnace and passing thrugh the floor of each hearth;

means for moving material to be processed in the furnace downwardly to successively adjacent hearth chambers upon rotation of said shaft;

means external of said furnace for generating high temperature gases to be conducted to selected hearth chambers for treating therein the material to be processed;

conduit means connecting said high temperature gas generating means to said breeching ports;

a blade of high temperature ceramic material formed with a bore along an axis thereof, said blade selectively adjusting the cross-sectional area of said conduit means;

a hollow shaft mounted transversely of said conduit and extending into said bore and keyed to said blade to impart rotary movement to said blade about said axis upon rotation of said shaft, whereby said blade selectively adjusts the cross-sectional area of said conduit means;

means for directing a flow of cooling medium through said shaft; and an insulating sleeve disposed between said shaft and the surface of said bore for restricting the transfer of heat from said blade to said shaft.

2. Apparatus for controlling the flow of high temperature gases in a conduit from a source thereof by selectively adjusting the cross-sectional area of said conduit, comprising:

a blade of high-temperature ceramic material formed with a bore along an axis thereof;

a hollow shaft mounted transversely of said conduit and extending into said bore and keyed to said blade to impart rotary movement to said blade about said axis upon rotation of said shaft whereby said blade selectively adjusts the cross-sectional area of said conduit;

means for directing a flow of cooling medium through said shaft; and an insulating sleeve disposed between said shaft and the surface of said bore restricting the transfer of heat from said blade to said shaft.

3. Apparatus for controlling the flow of high temperature gases in a conduit from a source thereof by selectively adjusting the cross-sectional area of said conduit, comprising:

a blade of ceramic material capable of withstanding temperatures of the order of about 2800° F. and formed with an enlarged hub along a major axis thereof and with a bore concentric with said hub;

a hollow shaft extending into said bore and keyed to said blade to impart rotary movement to said blade about said axis upon rotation of said shaft;

an insulating sleeve of ceramic fiber disposed between said shaft and the surface of said bore;

means for directing a flow of cooling medium through said shaft; and means for mounting said blade within a conduit and for rotating said shaft to adjust the disposition of said blade relative to said conduit between positions wherein said conduit is substantially fully open and substantially fully closed.

4. A multiple hearth furnace according to claims 1, 2 or 3, wherein said sleeve is formed of ceramic fiber having a thermal conductivity of less than about 2.5 BTU/in/Ft$^2$/Hr.

5. A multiple hearth furnace according to claims 1, 2, or 3, wherein the linear shrinkage of said sleeve is no more than about 5% at a service temperature of the order of 2800° F.

* * * * *